US008458840B2

(12) United States Patent
Galindo Sanchez et al.

(10) Patent No.: US 8,458,840 B2
(45) Date of Patent: Jun. 11, 2013

(54) DEVICE FOR BACK MASSAGE

(75) Inventors: Francisco Javier Galindo Sanchez, Sant Esteve Sesrovires (ES); Sergio Mezery, Barcelona (ES)

(73) Assignee: Paten Pro Dax Group, SL, Barcelona (ES)

( * ) Notice: Subject to any disclaimer, the term of this patent is extended or adjusted under 35 U.S.C. 154(b) by 281 days.

(21) Appl. No.: 13/123,620

(22) PCT Filed: May 8, 2009

(86) PCT No.: PCT/ES2009/000244
§ 371 (c)(1),
(2), (4) Date: Apr. 11, 2011

(87) PCT Pub. No.: WO2010/061011
PCT Pub. Date: Jun. 3, 2010

(65) Prior Publication Data

US 2011/0196272 A1 Aug. 11, 2011

(30) Foreign Application Priority Data

Nov. 3, 2008 (ES) ..... 200803128

(51) Int. Cl.
*A47K 7/04* (2006.01)

(52) U.S. Cl.
USPC ..... 15/21.1; 4/606; 601/114

(58) Field of Classification Search
USPC ..... 15/21.1, 97.1; 4/606; 601/114
See application file for complete search history.

(56) References Cited

U.S. PATENT DOCUMENTS

| | | | | |
|---|---|---|---|---|
| 3,372,604 | A | 3/1968 | Perry | |
| 5,345,640 | A | 9/1994 | Goss | |
| 5,561,869 | A | 10/1996 | Sarel | |
| 5,704,903 | A | 1/1998 | Jahnke | |
| 6,996,861 | B1 | 2/2006 | Clark, Jr. | |
| 7,451,513 | B2 * | 11/2008 | Torres | 15/21.1 |
| 8,272,799 | B1 * | 9/2012 | Yard | 401/6 |

FOREIGN PATENT DOCUMENTS

EA 2 249 195 B1 3/2006

OTHER PUBLICATIONS

International Search Report (PCT/ISA/210) issued on Oct. 2, 2009, by Spanish Patent Office as the International Searching Authority for International Application No. PCT/ES2009/000244.
Written Opinion (PCT/ISA/237) issued on Oct. 2, 2009, by Spanish Patent Office as the International Searching Authority for International Application No. PCT/ES2009/000244.

* cited by examiner

*Primary Examiner* — Randall Chin
(74) *Attorney, Agent, or Firm* — RatnerPrestia

(57) ABSTRACT

Device for back massage, in which each brush is removable, the face opposite the brush face having a prismatic axle for transmitting the action of the motor system, and in which the support has, for each brush, a prismatic seat combined with the aforementioned prismatic axle, at least one of the walls of the prism of the axle or of the seat having, moreover, a recess perpendicular to the wall to receive a part driven by a spring placed, in turn, inside a recess situated in a corresponding face of the seat or axle and in which each axle has, in turn, on the face opposite the brush face, a groove around said axle to receive a corresponding wall located on the support.

9 Claims, 3 Drawing Sheets

DEVICE FOR BACK MASSAGE

The present invention relates to a back massage device which has notable characteristics of novelty and inventive step.

The purpose of the device according to the invention is to perform massages on the back portion of the body, for comfort or to produce relaxation and/or pre-therapeutic effects in the back area, particularly in the muscular areas.

Document ES 2249195 discloses a device with the aforementioned characteristics that comprises multiple rotary brushes mounted on a support provided with means for fixing to a shower area, the brushes being driven mechanically by a motor system and said brushes defining a brush face provided with a surface for performing a massage and a face opposite said brush face.

The device according to the present invention is designed for fitting in bath or shower areas, for example to be fixed or embedded in a wall.

If the device is arranged in a shower area and the brushes are motor driven, the problem of brush maintenance arises. Indeed, it is desirable for the brushes to be removable for maintenance or replacement, but in this case the installation must be sufficiently tight. Moreover, the fitting/removal of the brushes must in turn be simple so that it can be carried out by the user. Finally, the device must be as simple and economical as possible.

The object of the present invention is to provide a solution to the aforementioned problems.

In particular, the present invention consists of a back massage device as mentioned above, characterised in that each brush is removable, the face opposite the brush face having a prismatic axle for transmitting the action of the motor system, and in that the support has, for each brush, a prismatic seat mating with said prismatic axle, having additionally at least one of the walls of the prism of the axle or of the seat, a recess perpendicular to the wall to receive a part driven by a spring which is placed, in turn, in a recess situated in a corresponding face of the seat or axle and in that each axle has, in turn, on the face opposite the brush face, a groove around said axle to receive a corresponding wall located on the support. Preferably, said recess to receive a part driven by a spring is located in at least one of the walls of the prismatic axle. Also preferably, the device has at least two of said recesses to receive a part driven by a spring.

The device according to the present invention is particularly but not exhaustively indicated for installation in shower areas. Preferably, therefore the support has means for fixing to a wall. In a preferred option, the brush support is movable on guides fixed in the wall. The movement on guides is produced preferably by means of a rack and pinion device actuated by a manual control.

Mechanical transmission to the brushes is produced preferably by means of an arrangement of axles and toothed drive wheels.

According to another aspect of the invention, the device may be arranged preferably embedded in a wall and more preferably it may have a mechanical system to provide movement to the device perpendicularly to the wall in which it is embedded.

For a better understanding the accompanying drawings show an embodiment of the back massage device according to the present invention as an explanatory but not limiting example.

Figure 1:
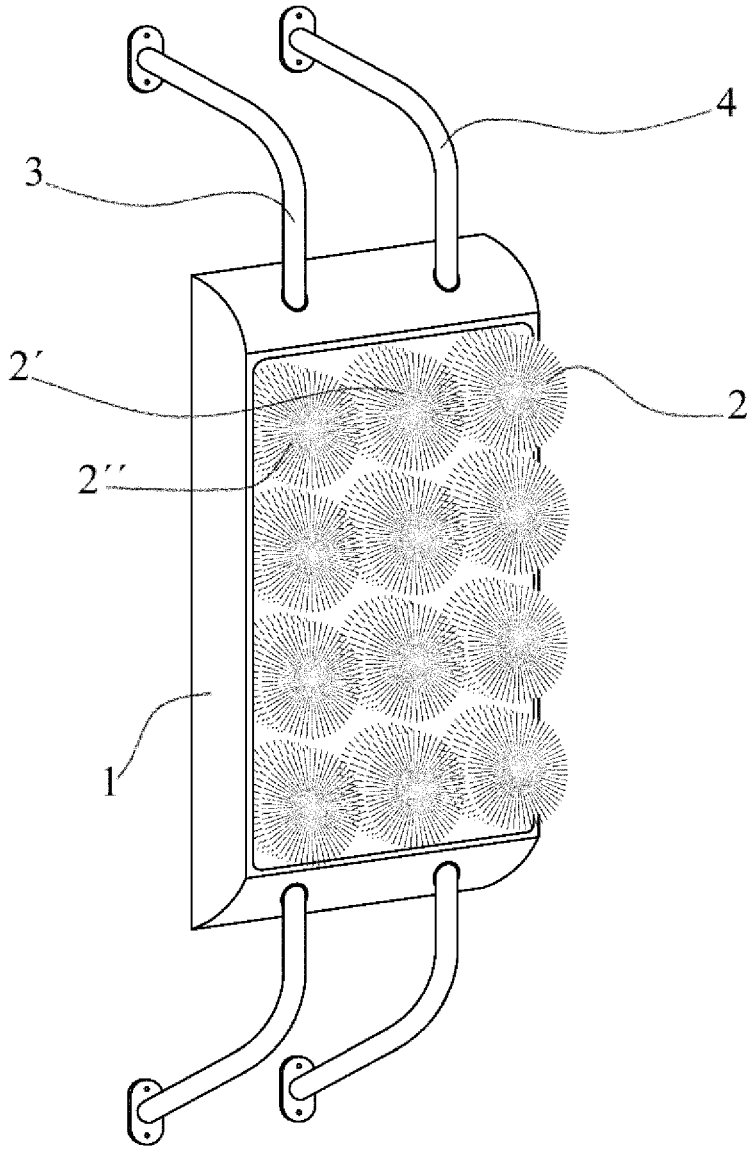
FIG. 1 is a perspective view of a back massage device, provided with removable brushes.

FIG. 1 is a perspective view of a back massage device to which the present invention can be applied. The device has multiple rotary brushes 2, 2', 2" mounted on a support 1 with arms 3, 4 for fixing to a wall. Although not shown in the figures, the brushes can be driven by a motor system as explained, for example, in document ES 2249195.

Figure 2:
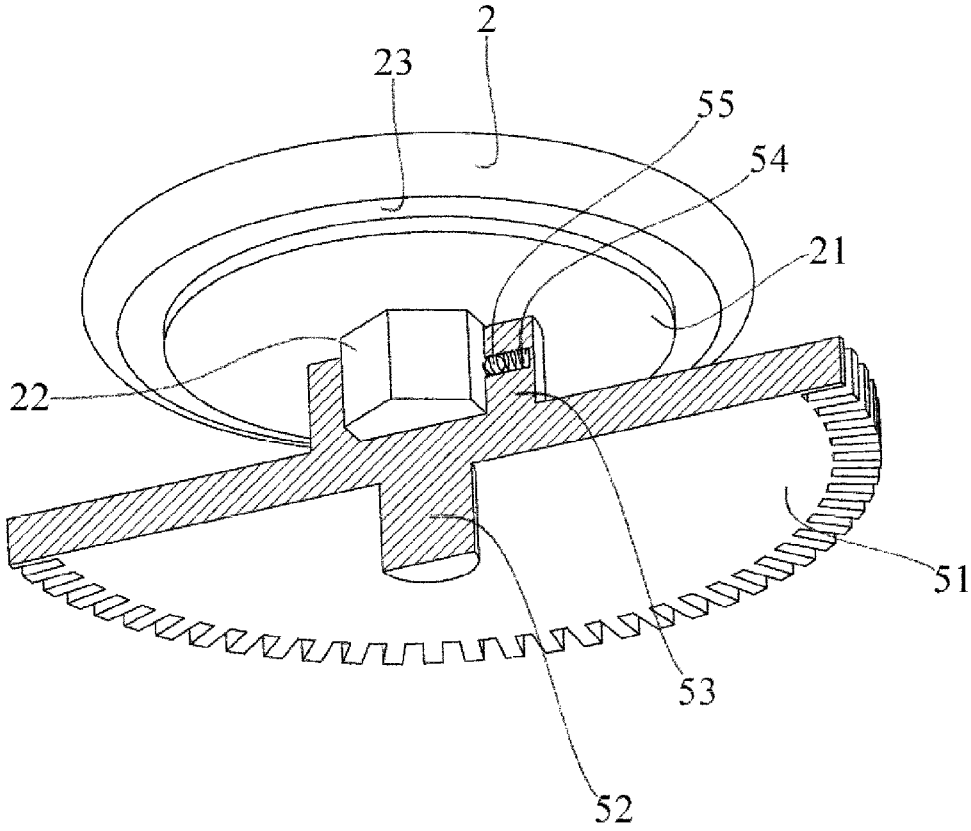
FIG. 2 is a perspective view in partial cross-section of a brush connection system of a back massage device according to the present invention.
Figure 3:
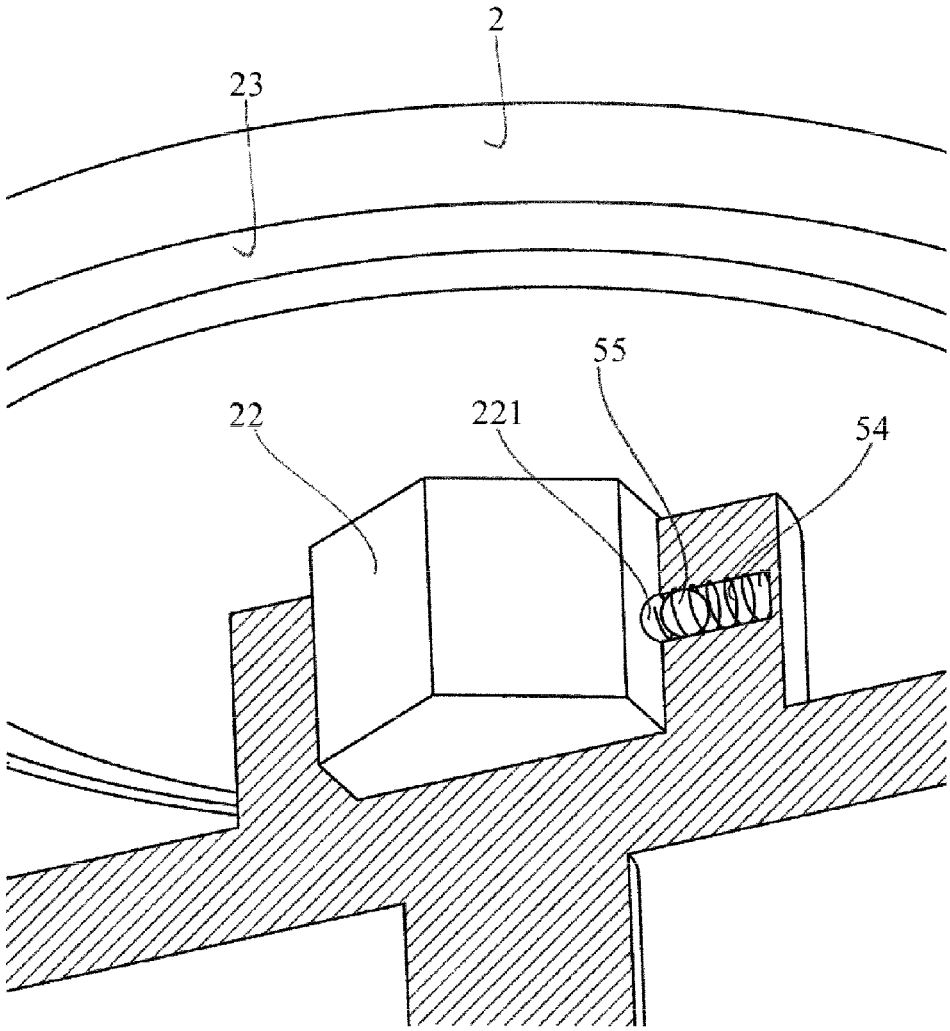
FIG. 3 is a detailed view according to the present invention.

FIGS. 2 and 3 show a brush-device connection according to the present invention. In the figures the brush 2 can be seen from the face 21 opposite the brush surface that performs a massage. As can be seen, to ensure tightness, the brush 2 has a groove 23 in which, optionally, a wall of the support is received, for example, a wall situated on the engaging disk 51 (not shown in the figure). For connection thereof to the support, the disk 2 has a prismatic axle 22 which is housed in a prismatic seat 53 integral with the engaging disk 51. The engaging disk 51 is subjected to the action of the motor system (not shown in the figures). To turn correctly, the engaging disk 51 has, in turn, a rotational axle 52.

To provide the connection, at least one (and preferably several) of the faces of the prismatic axle 22 has a recess 221 in which is housed a part 55 driven by a spring 54, which in turn is located in a recess situated in a prismatic face of the prismatic seat 53. The option shown is preferred, but it could also be positioned in a reverse arrangement, that is, with the part 55 driven by the spring 54 housed in the prismatic axle 22.

Although the invention has been shown applied to a particular type of massage device, it should be understood that the details thereof may vary. Thus, for example, the device could be movable along the guides 3, 4 by means of a rack and pinion system actuated by a control. Or alternatively, the assembly could be arranged embedded in the wall with a mechanical system to provide movement to the device perpendicularly to the wall in which it is embedded.

Although the invention has been described with reference to preferred embodiments, said embodiments should not be considered as limiting the invention which is defined by the broadest interpretation of the following claims.

The invention claimed is:

1. A back massage device comprising multiple rotary brushes mounted on a support, the brushes driven mechanically by a motor system and said brushes defining a brush face provided with a face for performing a massage and a face opposite said brush face, wherein each brush is removable, the face opposite the brush face having a prismatic axle for transmitting the action of the motor system, and in that the support has, for each brush, a prismatic seat mating with said prismatic axle, at least one wall of the prism of the axle or of the seat having a recess perpendicular to the wall to receive a part driven by a spring which is placed, in turn, in a recess situated in a corresponding face of the seat or axle and in that each axle has, in turn, on the face opposite the brush face, a groove around said axle to receive a corresponding wall located on the support.

2. A device according to claim 1, wherein said recess to receive a part driven by a spring is located in at least one of the walls of the prismatic axle.

3. A device according to claim 1, comprising at least two of said recesses to receive a part driven by a spring.

4. A device according to claim 1, wherein the support includes means for fixing the device to a wall.

5. A device according to claim 4, wherein the brush support is movable on guides fixed to the wall.

6. A device according to claim 5, wherein the movement on guides is produced by means of a rack and pinion device actuated by a manual control.

7. A device according to claim 1, wherein the brushes are driven by the motor system by means of an arrangement of axles and toothed drive wheels.

8. A device according to claim 1, wherein the device is embedded in a wall.

9. A device according to claim 1, further comprising a mechanical system to provide movement to the device perpendicularly to the wall in which it is embedded.

* * * * *